United States Patent [19]

Cartwright

[11] Patent Number: 4,480,755

[45] Date of Patent: Nov. 6, 1984

[54] TOOL STORAGE DEVICE

[75] Inventor: Jerry G. Cartwright, Ellwood City, Pa.

[73] Assignee: Wesco Manufacturing, Inc., Aurora, Ill.

[21] Appl. No.: 417,600

[22] Filed: Sep. 13, 1982

[51] Int. Cl.[3] ..... A47F 7/00

[52] U.S. Cl. ..... 211/60 T; 248/551; 248/220.3; 211/4; 211/163

[58] Field of Search ..... 248/220.3, 221.1, 551, 248/222.1, 225.4; 211/60 T, 163, 4, 7; 269/236, 235

[56] References Cited

U.S. PATENT DOCUMENTS

| | | | |
|---|---|---|---|
| 1,801,453 | 4/1931 | Patterson . | |
| 1,842,147 | 1/1932 | Cardner | 269/235 X |
| 3,163,275 | 12/1964 | Andrews et al. . | |
| 3,172,540 | 3/1965 | Berge . | |
| 3,516,552 | 6/1970 | Salava . | |
| 3,517,827 | 6/1970 | Crosslen et al. | 211/163 |
| 3,785,501 | 1/1974 | Canning . | |
| 3,827,569 | 8/1974 | Canning . | |

*Primary Examiner*—Ramon S. Britts

*Assistant Examiner*—Sarah A. Lechok

*Attorney, Agent, or Firm*—Laubscher, Philpitt & Laubscher

[57] ABSTRACT

A tool storage device is disclosed including a cabinet having a plurality of vertically arranged planar side walls each containing a plurality of apertures adapted to receive a portion of a support hook. The cabinet is characterized by an internal assembly for locking the hook portions within the apertures to provide stable support for hand tools and the like. The locking assembly includes a plurality of locking plates arranged parallel to and spaced from the cabinet side walls, respectively, and a rotatable cam for displacing the locking plates relative to the side walls between locked positions in which the locking plates press the hook portions against the inner surfaces of the associated side walls, respectively, and unlocked positions in which the locking plates release the hook portions, respectively. Accordingly, when the locking assembly is in its unlocked position, a plurality of support hooks may be arranged in any desired configuration over the surfaces of the cabinet side walls, and when the locking assembly is in its locked position, the support hooks are fixed at the selected positions on the side walls.

6 Claims, 5 Drawing Figures

TOOL STORAGE DEVICE

BACKGROUND OF THE INVENTION

The present invention relates to a rotating tool storage cabinet having peg board type walls adapted to receive a plurality of hooks for supporting tools and the like. Behind each of the walls is a metal plate which is pressed adjacent the associated wall to lock the hooks in place, whereby sturdy support for the tools is provided.

BRIEF DESCRIPTION OF THE PRIOR ART

Various tool or article storage devices are well-known in the patented prior art as evidenced by the patents to Patterson U.S. Pat. No. 1,801,453, Berge U.S. Pat. No. 3,172,540, and Salava U.S. Pat. No. 3,516,552. The Patterson patent discloses a tool rack wherein tool supporting hooks are secured to a wire mesh panel. The hooks include a portion wrapped around a strand of the mesh and a clamp plate is provided for each hook and has its ends bent around the wires of the mesh to lock the hooks in place. The Berge patent discloses a modular wall panel including self-locking detachable brackets for supporting various articles. The panel comprises a plurality of horizontal rails each having a lip portion about which the brackets are hooked.

The Salava patent discloses an article support system and fixture wherein support hooks are fastened in a perforated board by an interference fit.

While these prior devices normally operate quite satisfactorily, they each suffer from certain inherent drawbacks in that it is difficult to quickly remove and rearrange the supporting hooks and brackets and still provide a locking arrangement wherein the hooks and brackets are locked in a fixed position.

Other devices for locking articles onto a display panel are disclosed in the patents to Andrews et al. U.S. Pat. No. 3,163,275 and Canning U.S. Pat. Nos. 3,785,501 and 3,827,569. In the Canning U.S. Pat. No. 3,827,569, for example, a pegboard type display rack is disclosed including holding devices having hangers on which merchandise is hung. A releasable locking assembly is provided to prevent removal of the merchandise. One drawback of these prior locking display panels is that the article support devices may not be rearranged on the display panels.

SUMMARY OF THE INVENTION

Accordingly, it is a primary object of the present invention to provide a tool storage device including a cabinet having a generally rectangular horizontal cross-sectional configuration, the cabinet including a plurality of vertically arranged planar side walls each containing a plurality of apertures each adapted to receive a portion of a support hook. An assembly for locking the hook portions within the apertures is arranged within the cabinet. The locking assembly includes a plurality of locking plates arranged parallel to and spaced from the side walls, respectively. The assembly further includes means for displacing the locking plates relative to the cabinet side walls between locked positions in which the locking plates press the hook portions against the inner surfaces of the associated side walls, respectively, and unlocked positions in which the locking plates release the hook portions, respectively. Thus, when the locking plates are in the unlocked positions, a plurality of support hooks may be arranged at desired locations on the outer surfaces of the side walls by passing the hook portions through the side wall apertures, and subsequently, when the locking plates are in the locked positions, the support hooks are fixed in the selected locations on the cabinet side wall surfaces to support tools and the like.

According to another object of the invention, springs are provided for biasing each of the locking plates in a direction away from the associated side wall toward the unlocked position, respectively.

According to a more specific object of the invention, at least one horizontally arranged rotatable cam plate is provided for displacing the locking plates. The cam plates include a plurality of projections adapted for operable engagement with each of the locking plates against the biasing force of the springs, respectively. The cam plates are connected with a vertical shaft which is rotatably connected with and coaxially arranged within the cabinet. Rotation of the shaft rotates the cam plates to displace the locking plates between the locked and unlocked positions.

It is a further object of the invention to provide a bottom wall for the cabinet upon which the lower end of the shaft is supported. The tool storage device includes a stationary base and means for rotatably connecting the cabinet bottom wall with the base.

BRIEF DESCRIPTION OF THE FIGURES

Other objects and advantages of the present invention will become apparent from a study of the following specification when viewed in the light of the accompanying drawing, in which.

DETAILED DESCRIPTION

Figure 1:
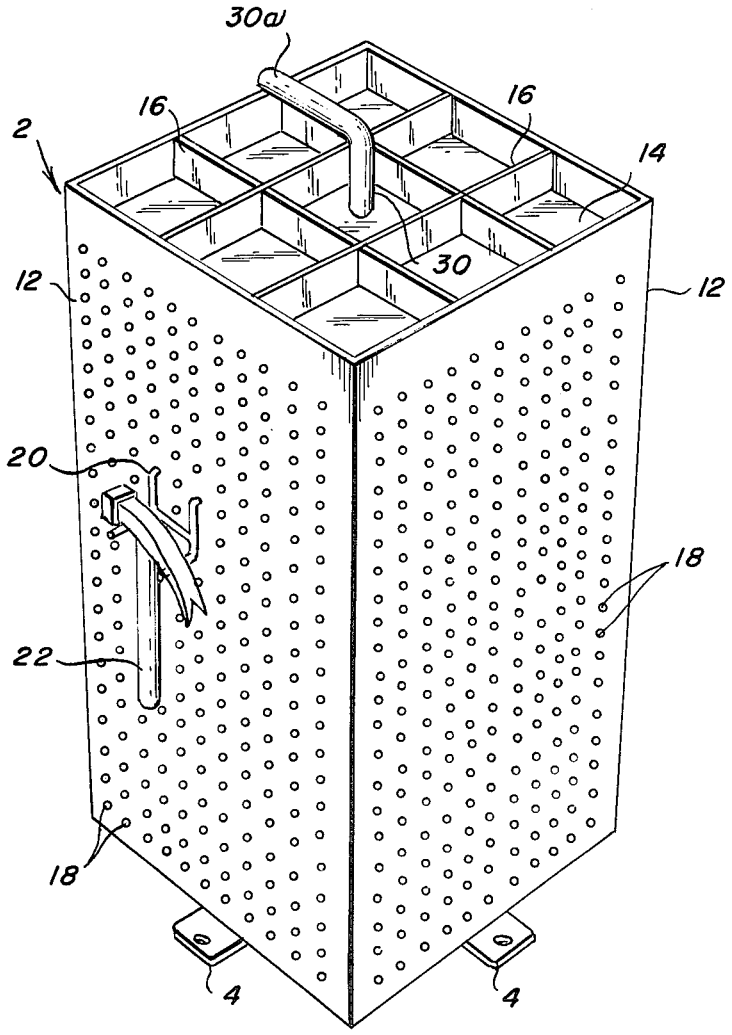
FIG. 1 is a front perspective view of the tool storage cabinet.

Referring first to FIG. 1, the tool storage device of the present invention is shown. The device includes a storage cabinet 2 and a stationary base 4 with which the cabinet is rotatably connected.

Figure 3:
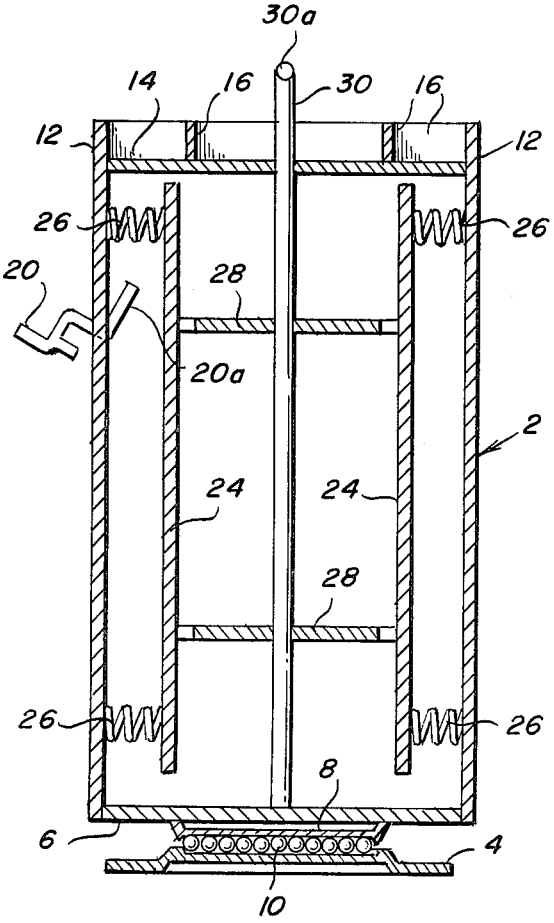
Figure 5:
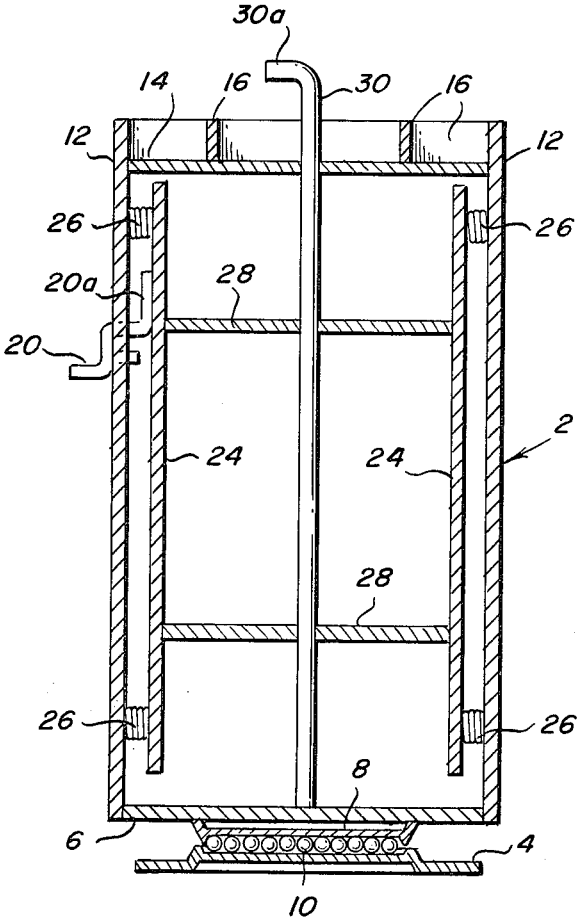

More particularly, as shown in FIGS. 3 and 5, the cabinet includes a bottom wall 6 with which a bearing plate 8 is connected. A plurality of ball bearings 10 are arranged between the bearing plate and the stationary base 4, whereby the cabinet is rotatable relative to the base.

The cabinet has a generally rectangular horizontal cross-sectional configuration and includes a plurality of vertical side walls 12 which are connected together at their vertical edges in any suitable fashion. Similarly, the lower edges of the cabinet side walls are connected with the bottom wall.

The cabinet further includes a top wall 14 which is connected with the cabinet side walls. The top wall is preferably recessed from the upper edges of the side walls to define a support tray as shown in FIGS. 1, 3, and 5. A plurality of partitions 16 are provided to divide the tray into individual areas for storing screws, nuts, bolts, and the like.

Referring once again to FIG. 1, each of the cabinet side walls contains a plurality of apertures 18 which are preferably arranged in rows and columns with equidistant spacing therebetween. Each aperture is adapted to receive a portion of a support hook 20 which is used to support a tool such as a hammer 22 on the face of the cabinet side wall. Each side wall thus functions as a peg board upon which various articles are supported. While the side walls may be formed of any rigid material, a lightweight metal is preferred for increased durability and support strength. Similarly, various types of support hooks may be used with the storage cabinet. Typically, the hooks include at least one upper bent portion 20*a* (FIG. 3) which is inserted through an aperture in the side wall. The remaining body portion of the hook is then pivoted downwardly to rest against the outer surface of the side wall, with the upper bent portion being adjacent the inner surface of the side wall.

Where the hooks are used to support a heavy tool such as the hammer 22, it is imperative that the hooks be locked in a fixed position on the side wall to provide sturdy support for the tool. Accordingly, the tool storage device of the present invention includes a hook locking assembly as shown more particularly in FIGS. 2–5. The locking assembly includes a plurality of locking plates 24 which are arranged in parallel spaced relation relative to the inner surfaces of the side walls, respectively. The locking plates are movable between an unlocked position shown in FIGS. 2 and 3 and a locked position shown in FIGS. 4 and 5 as will be set forth in greater detail below.

Figure 2:
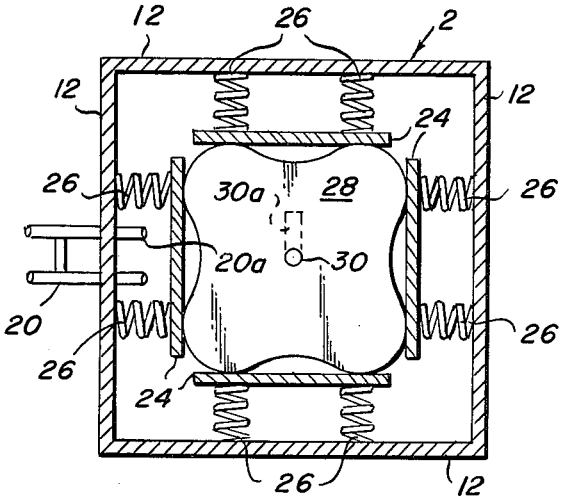
FIGS. 2 and 3 are top and front sectional views, respectively, of the cabinet with the locking assembly in its unlocked position.

The locking plates are connected with the associated side walls by a plurality of springs 26 which normally bias the locking plates away from the associated side walls toward the unlocked position shown in FIGS. 2 and 3. According to a preferred embodiment of the invention, the opposite ends of the springs are connected with the opposed surfaces of the side wall and its associated locking plate by any suitable means such as a weld.

It will be apparent from a study of FIGS. 2 and 3 that when the locking assembly is in its unlocked position, the hook portions 20*a* may be freely inserted into and withdrawn from the apertures contained in the cabinet side walls, whereby the hooks may be arranged at any location on the faces of the side walls.

Figure 4:
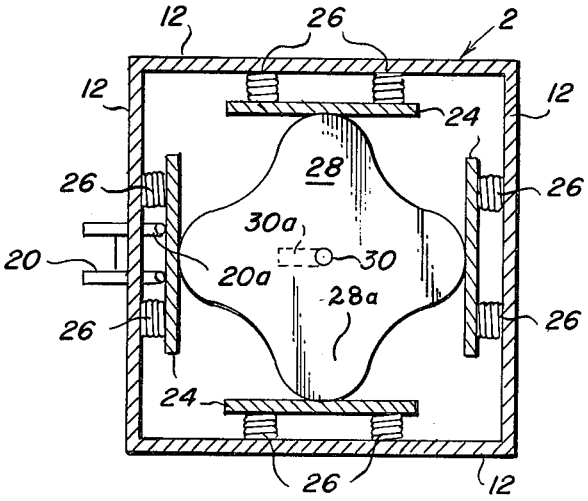
FIGS. 4 and 5 are top and front section views, respectively, of the cabinet with the locking assembly in its locked position.

The locking assembly further includes a mechanism for displacing the locking plates toward a locked position shown in FIGS. 4 and 5. A pair of horizontal cam plates 28 are connected in vertically spaced relation with a vertical shaft 30 which is rotatably connected with and coaxially arranged within the tool storage cabinet. The lower end of the shaft is supported by the bottom wall 6 of the cabinet. Specifically, journals (not shown) may be provided to rotatably connect the vertical shaft with the top and bottom walls of the cabinet. The shaft includes a handle portion 30*a* arranged outside of the cabinet. The handle may be gripped by a user of the device and rotated relative to the cabinet to rotate the shaft and cam plates.

Each cam plate includes a plurality of projections 28*a*, there being at least one projection for each locking plate. Upon rotation of the shaft and cam plates, the cam plate projections 28*a* push against the associated locking plates to displace the locking plates against the biasing force of the springs 26 and toward the associated side wall to the locked position shown in FIGS. 4 and 5. When in the locked position, the locking plates press the hook portions 20*a* against the inner surfaces of the associated side walls to fix the support hooks in the selected locations on the face of the side walls. The fixed hooks provide sturdy support for tools, articles, and the like. Further rotation of the cam plates (or rotation of the cam plates in the opposite direction) will cause the locking plates to be displaced to the unlocked position shown in FIGS. 2 and 3, owing to the biasing forces of the springs 26. The hook portions 20*a* are released from the grip between the locking plates and associated side wall, whereby the support hooks are free to pivot to withdraw the portions 20*a* from the apertures 18 in order to relocate or replace the hooks.

The locking mechanism thus affords quick manual fixing and release of the support hooks by the user of the device. When in the locked position, the hooks cannot be removed or misaligned when removing or replacing a tool. Tool storage and retrieval can be accomplished with one hand since there is no necessity of holding or aligning the support hooks. The tool storage device thus provides convenient tool availability and eliminates cluttered tool boxes, drawers, or the use of large areas of wall space as with conventional peg boards.

Like the side walls, the base, top and bottom walls, locking plates, cam plates, and shaft may all be formed from a lightweight durable metal such as steel. Furthermore, the cam plates and shaft can be formed as an integral unit for ease of assembly.

While in accordance with the provisions of the patent statutes the preferred forms and embodiments of the invention have been illustrated and described, it will be apparent to those skilled in the art that various changes and modifications may be made without deviating from the inventive concepts set forth above.

What is claimed is:

1. A tool storage device, comprising (a) a cabinet having a generally rectangular horizontal cross-sectional configuration, said cabinet including a plurality of vertically arranged planar side walls each containing a plurality of apertures each adapted to receive a portion of a support hook;

(b) means arranged within said cabinet for locking said hook portions within said apertures, said locking means including (1) a plurality of locking plates arranged parallel to and spaced from said side walls, respectively;

(2) spring means connected with said locking plates for normally biasing each of said locking plates in a direction away from the associated side wall toward unlocked positions in which said locking plates release said hook portions, respectively; and (3) means for displacing said locking plates relative to said cabinet side walls between the unlocked positions and locked positions in which said locking plates press said hook portions against the inner surfaces of the associated side walls, respectively, said displacement means including horizontally arranged cam means including a plurality of projections, at least one of said cam projections being adapted for operable engagement with each of said locking plates against the biasing force of said spring means, respectively, said cam means being rotatable about the vertical axis of said cabinet, whereby when said locking plates are in the unlocked positions, a plurality of support hooks may be arranged at desired locations on the outer surfaces of said side walls by passing said hook portions through said side wall apertures, and subsequently when said cam means are rotated to displace said locking plates to the locked positions, said support hooks are fixed in the selected locations on the cabinet side wall surfaces to support tools, materials, and the like.

2. Apparatus as defined in claim 1, wherein said displacement means further comprises a vertical shaft rotatably connected with, and coaxially arranged within said cabinet, said cam means being connected for rotation with said shaft, said shaft including a handle portion arranged outside of said cabinet for rotating said shaft.

3. Apparatus as defined in claim 2, wherein said cam means comprise at least a pair of vertically-spaced horizontally-arranged cam plates.

4. Apparatus as defined in claim 2, wherein said cabinet includes a bottom wall connected with said side walls, the lower end of said shaft being supported by said bottom wall.

5. Apparatus as defined in claim 3, and further comprising (c) a stationary base; and (d) means for rotatably connecting said cabinet bottom wall with said base.

6. Apparatus as defined in claim 5, wherein said cabinet includes a top wall recessed from the upper edges of and connected with said side walls, thereby to define a storage shelf.

* * * * *